US007464576B2

(12) United States Patent
Turner et al.

(10) Patent No.: US 7,464,576 B2
(45) Date of Patent: Dec. 16, 2008

(54) SINGLE ACTION PRESS FOR MANUFACTURING SHELLS FOR CAN ENDS

(75) Inventors: Timothy L. Turner, Pecatonica, IL (US); Michael R. Gogola, Itasca, IL (US)

(73) Assignee: Rexam Beverage Can Co., Chicago, IL (US)

( * ) Notice: Subject to any disclaimer, the term of this patent is extended or adjusted under 35 U.S.C. 154(b) by 0 days.

(21) Appl. No.: 11/899,639

(22) Filed: Sep. 6, 2007

(65) Prior Publication Data

US 2008/0025820 A1 Jan. 31, 2008

Related U.S. Application Data

(62) Division of application No. 10/890,918, filed on Jul. 13, 2004, now Pat. No. 7,305,861.

(51) Int. Cl.
*B21D 22/00* (2006.01)

(52) U.S. Cl. ..... 72/350

(58) Field of Classification Search ..... 72/344, 72/348–350

See application file for complete search history.

(56) References Cited

U.S. PATENT DOCUMENTS

| | | | | |
|---|---|---|---|---|
| 3,886,881 | A | 6/1975 | Pearce et al. | 413/15 |
| 4,516,420 | A | 5/1985 | Bulso, Jr. et al. | 72/329 |
| 4,568,230 | A | 2/1986 | Brown | 413/66 |
| 4,587,825 | A | 5/1986 | Bulso, Jr. et al. | 72/329 |
| 4,587,826 | A | 5/1986 | Bulso, Jr. et al. | 72/329 |
| 4,640,116 | A | 2/1987 | Brown | 72/356 |
| 4,713,958 | A | 12/1987 | Bulso, Jr. et al. | 72/348 |
| 4,715,208 | A | 12/1987 | Bulso, Jr. et al. | 72/348 |
| 4,716,755 | A | 1/1988 | Bulso, Jr. et al. | 72/349 |
| 4,723,882 | A | 2/1988 | Wissman et al. | 413/66 |

(Continued)

OTHER PUBLICATIONS

PCT International Search Report dated Sep. 27, 2005 in PCT/US 2005/023885.

(Continued)

*Primary Examiner*—Dana Ross
*Assistant Examiner*—Teresa Bonk
(74) *Attorney, Agent, or Firm*—McDonnell Boehnen Hulbert & Berghoff LLP

(57) ABSTRACT

A single action press for forming a shell used to make a can end includes a first tool and an opposed second tool. The first tool includes a die center insert that performs a forming operation on disc cut from a sheet of end material. The first tool is configured and arranged wherein force is supplied to the die center insert during the downstroke and force is removed from the die center insert at the bottom of the downstroke and at the start of the upstroke, to thereby enable the die center insert to disengage from the shell. One specific embodiment uses a die center piston and compressed air to apply force to the die center insert. Another embodiment uses a cam and cam follower arrangement to remove axial forces at the bottom of the downstroke and either springs or gas pressure to apply force to the die center insert during the downstroke. Actuators are provided in the first tool to reestablished downward forces on the die center insert by the time the top of the upstroke so that the press cycle can be repeated.

4 Claims, 14 Drawing Sheets

U.S. PATENT DOCUMENTS

| | | | | |
|---|---|---|---|---|
| 4,808,052 | A | 2/1989 | Bulso, Jr. et al. | 413/8 |
| 4,955,223 | A | 9/1990 | Stodd et al. | 72/336 |
| 4,977,772 | A | 12/1990 | Bulso, Jr. et al. | 72/336 |
| 5,272,901 | A | 12/1993 | Cudzik | 72/347 |
| 5,626,048 | A | 5/1997 | MClung | 72/336 |
| 5,628,224 | A | 5/1997 | McClung et al. | 72/336 |
| 5,823,730 | A | 10/1998 | La Rovere | 413/12 |
| 5,857,374 | A | 1/1999 | Stodd | 72/348 |
| 6,079,249 | A | 6/2000 | Turner et al. | 72/329 |
| 6,658,911 | B2 | 12/2003 | McClung | 72/336 |
| 7,036,348 | B2 | 5/2006 | McClung | 72/348 |
| 2005/0044921 | A1 | 3/2005 | MCClung | 72/348 |

OTHER PUBLICATIONS

PCT Written Opinion in PCT/US 2005/023885.

SINGLE ACTION PRESS FOR MANUFACTURING SHELLS FOR CAN ENDS

BACKGROUND OF THE INVENTION

A. Field of the Invention

This invention relates to the can end manufacturing art, and more particularly to a novel construction and arrangement of press that is used to form a "shell." The shell is subsequently converted in a separate conversion press into an end for closing off the open end of a can body.

B. Description of Related Art

It is well known to draw and iron a sheet metal blank to make a thin-walled can body for packaging beverages, such as beer, fruit juice or carbonated beverages. In a typical manufacturing method for making a drawn and ironed can body, a circular disk or blank is cut from a sheet of light gauge metal (such as aluminum). The blank is then drawn into a shallow cup using a cup forming punch and die equipment. The cup is then transferred to a body maker or can forming station. The body maker draws and irons the side walls of the cup to approximately the desired height and forms dome or other features on the bottom of the can. After formation of the can by the body maker, the top edge of the can is trimmed. The can is transferred to a necking station, where neck and flange features are formed on the upper region of the can. The flange is used as an attachment feature for permitting the lid for the can, known as an "end" in the art, to be secured to the can.

The end is the subject of a different manufacturing process and involves specially developed machines and systems to manufacture such ends in mass quantities. Representative patents describing end manufacturing methods and presses used to make such ends include Buhrke, U.S. Pat. No. 4,106,422, and Herrmann, U.S. Pat. No. 3,888,199, A press combining formation and shell conversion operations is described in Turner et al., U.S. Pat. No. 6,533,518. After the ends are formed, they are sent to a curling station where a peripheral curl is provided to the end. The peripheral curl is used in a seaming operation to join the can end to the can body. After curling, the ends are sent in stick form to a compound liner station. A water-based compound sealer is applied to the ends in the compound liner station. From there the ends are fed to an inspection station and to a dryer station where the compound is subjected to heated forced air to dry the compound. If a solvent-based compound is used, then no drier is needed. The ends then placed in stick form, bagged, and then loaded on pallets for shipping In the mid-to late 1980's, the art adopted a two-stage type of system for manufacturing can ends. The system uses a shell press that forms shells from a coil of stock material, and one or more end conversion presses that converts the shell into a finished end. A representative prior art shell press and end conversion system is illustrated schematically in FIG. 1. The end manufacturing system 10 of FIG. 1 operates as follows. A coil stock feed mechanism 12 supplies a continuous sheet of end material (e.g., aluminum or steel), to a shell press 14. The shell press 14 has a set of tools that form a shell in the sheet of end material and blanks the shell from the sheet. Shell presses such as shown in FIG. 1 are made by companies such as Formatec Tooling Systems, Inc., Can Industry Products, and Redicon Corp. (now Stolle Machinery, Inc.) and are well known in the art. Representative patents include U.S. Pat. Nos. 4,516,420, 4,587,825, 4,713,958, 4,715,208, 4,716,755, 4,808,052, 4,977,772, 5,626,048, 5,628,224, and 6,658,911, the contents of which are incorporated by reference herein. The shell press 14 in the instant example is a twenty four-out press (i.e., it forms twenty four shells in the sheet of material a direction transverse or oblique to the direction of movement of the sheet in the press). Shells are ejected out both sides of the press 14 and sent to curlers 16, where an edge curl is formed in the periphery of the shell. A representative shell 15 shown in FIG. 1A.

After curling, the shells are placed in stick form and moved along track work indicated at 20 to a balancer 22. The balancer 22 is a robotic distribution machine. It is needed because the curlers 16 are supplying shells along six sets of track work 20, whereas in the downstream direction there are only four sets of track work leading to four liner machines 24. The balancer 22 is used to collect the ends and appropriately distribute them to track work leading to the lining machines 24. The lining machines 24 add a compound liner to the shells. The lining machines supply the shells to a drying machine 26 (if a water-based compound is used), which dries the compound liner with forced air. The drying machine 26 is not needed if a solvent-based compound is used.

The drying machines 26 supply the shells along another set of track work 30 to a second balancer 32. The balancer 32 supplies shells in stick form to three sets of track work 34, 36 and 38 leading to three separate shell conversion presses 40. The conversion presses 40 take the shells of FIG. 1A and complete the formation of the end features in the shell. The conversion presses 40 also have a set of tools that receive a continuous sheet of tab stock from a source 42 and form tabs in the tab stock. The conversion presses 40 attach the tab to the shell, complete the formation of the ends, and supply the finished ends to three sets of track work 43 leading to three bagging stations 44. The converted ends are bagged in stick form and loaded on pallets for distribution to the site where the cans are filled with product.

The conversion presses 40 of FIG. 1 are also known in the art and commercially available from Stolle Machinery Inc., Dayton Reliable Tool & Mfg. Co., and Service Tool Company, among others. They are also described in the patent literature. See U.S. Pat. No. 3,886,881, U.S. Pat. No. 4,723,882; U.S. Pat. No. 4,568,230, and U.S. Pat. No. 4,640,116, the contents of each of which is incorporated by reference herein. The tab presses for forming tabs in the sheet of tab stock are also known and commercially available. See, e.g., the Stolle Conversion System 8 shell conversion press available from Stolle Machinery Inc., and the above referenced '230 patent. The details of the work stations and forming operations performed on the shell in a conversion press 40 will depend on the type of end and the requirements of the customer.

The present invention relates to an improved shell press 14 that forms shells out of flat stock fed into the press. The shell press of this invention can be used in the system of FIG. 1 for the shell press 14. Shell presses known in the art generally fall into one of two categories: single action and double action presses. Single action presses use a single driving mechanism (ram device) to move the upper tool. Double action presses use two driving rams, an inner ram and an outer ram. Double action presses are shown for example in U.S. Pat. Nos. 4,713,958 and 4,977,772, assigned on its face to Redicon, and U.S. Pat. No. 5,626,048, assigned on its face to Can Industry Products. Double action presses are considerably more complex and costly machines and are more expensive to maintain and operate. The features of this invention allow for a single action press to be used to make shells, and thus presents a potential for significant cost savings for can end manufacturers.

SUMMARY OF THE INVENTION

A single action press is provided for manufacturing a shell for a can end. In a first aspect, the press comprises a first tool and an opposed second tool. For convenience, the first tool is occasionally referred to herein as the "upper tool" and the second tool is referred to as the "lower tool", since that is arrangement shown in the drawings and used in the illustrated embodiment. The tools can be oriented such that either the first or the second tool could be positioned above the other, hence the directional terms "downward," "upward," "upper" and "lower", "upstroke", "downstroke" and the like are intended to cover either arrangement of the opposed tools.

A die center insert is provided in the first tool. The die center insert is adapted for engaging a disc cut from a sheet of end material to perform a shell forming operation. The press is further characterized in having a down stroke wherein the first and second tools move towards each other to form the shell, the down stroke followed by an upstroke.

The first tool is configured and arranged wherein force is supplied to the die center insert during the downstroke and force is removed from the die center insert at the bottom of the downstroke and at the start of the upstroke, to thereby enable the die center insert to disengage from the shell. One specific embodiment uses a die center piston and compressed air to apply force to the die center insert. Another embodiment uses a cam and cam follower arrangement to remove axial forces at the bottom of the downstroke and either springs or gas pressure to apply force to the die center insert during the downstroke. Actuators are provided in the first tool to reestablished downward forces on the die center insert by the time the top of the upstroke so that the press cycle can be repeated.

In one embodiment, the first tool includes a source of compressed gas, and a die center piston coupled to the die center insert. The compressed gas acts on the piston and causes axial force to be imparted to the die center insert during the downstroke. At the bottom of the downstroke, the press action is such that the piston moves into the void region formerly occupied by compressed gas, causing the compressed gas to be removed from the top of the piston, and thereby removing the axial force during the upstroke.

In another embodiment, the first tool is constructed such that the means for applying axial force to the die center insert in an axial direction comprises a spring (or air pressure) and the axial force is removed in the upstroke by a cam and cam follower arrangement. In the downstroke, downward force is applied to the die center insert by means of a spring or by compressed air. At the bottom of the downstroke, a cam is slid over to a position supporting a cam follower coupled to or integral with the die center post into a position such that the axial force on the die center insert and shell is removed. During the upstroke, this condition is maintained. Later in the upstroke, actuator cams engage the cam and move the cam back to its original position, such that the cycle of the press can be repeated.

The separation of the die center insert from the shell during the initial part of the upstroke helps insure that the forming operations on the shell are not disturbed as the tools separate. For example, a peripheral corner fold may be formed in the center panel of the shell. In the press illustrated below, the fold operation is performed by a form punch insert at the bottom of the down stroke of the press. In a prior art single action press, when the first and second tools separate, the die center insert remains engaged with the center panel of the end while the die core ring moves upwardly, which tends to distort, destroy, otherwise disturb the fold. By virtue of this invention, the first tool is constructed and arranged such that axial force on the die center insert is removed at the bottom of the down stroke, such that when the upstroke begins, the die center insert is no longer engaged with the shell and exerts essentially no force thereon (gravitational force may be present but are insignificant). The shell simply remains clamped between the first and second tools during the initial portion of the upstroke to thereby retain the shell in the press. The upper and lower tools separate completely during a later portion of the upstroke to thereby allow the shell to be stripped from the press (e.g., using compressed air).

In one embodiment, a die center piston is rigidly coupled to the die center insert. An actuator pin is provided which engages with the die center piston during the upstroke to thereby move the die center piston such that compressed gas can enter a cavity or void axially located above the die center piston and again exert the axial force on the die center piston and die center insert, such that in the next cycle of the press the die center insert is in condition to perform the required forming operations in the next press cycle.

In another aspect of the invention, an upper tool is provided for a press for manufacturing a shell for a can end. The upper tool includes a die center insert for engagement with a disc cut from a sheet of end material and performing a forming operation on the sheet of end material when the upper tool is moved to a closed position relative to a lower tool in the press. The upper tool also includes a die center piston coupled to the die center insert. The upper tool includes a void region proximate to the die center piston for containing compressed gas. The void region includes a peripheral void portion and a cavity portion axially located relative to the die center piston wherein the presence of compressed gas in the cavity portion causes an axial force to be applied to the die center piston (and in turn to the die center insert).

The die center piston is moveable relative to the cavity portion to displace compressed gas from the cavity portion into the peripheral void portion and thereby substantially remove the axial force from the die center piston. Consequently, when the upper and lower tools separate during the upstroke of the press, the die center insert disengages from the shell to thereby insure that the forming operations on the shell are not disturbed. An actuator pin is provided for engaging the die center piston and moving the die center piston to thereby allow compressed gas to re-enter the cavity portion. The timing of the actuator pin is such that when the pin engages the die center piston to move the piston and allow the compressed gas to enter the cavity above the die center piston, the tools have separated sufficiently such that when the axial force is applied to the die center piston the die center insert does not engage the shell, or, alternatively, the shell has already been stripped from the press.

In another aspect, a method is provided for manufacturing a shell for a can end in a single action press. The press has a down stroke followed by an upstroke. The method comprises the steps of:

1. in the down stroke,
   a) clamping a disc formed from a sheet of end material between first and second opposed tools in the press;
   b) performing a forming operation on the disc with a die center insert in the first tool;
2. in the upstroke,
   a) initially retaining the clamping of the shell between the first and second tools,
   b) while the clamping in step 2.a) is performed, placing the center die insert into a condition of disengagement from the shell (thus insuring that the forming operations are not disturbed);

and c) releasing the clamping in step 2.a) and thereafter removing the shell from the press.

In one preferred embodiment, the method continues with a step of actuating a die center piston coupled to the die center insert so as to allow compressed gas to enter a cavity above the die center piston and exert a downward, axial force on the die center piston and ready the die center insert and piston for the next cycle of operation of the press.

In an alternative embodiment, a cam and a cam follower move in a manner such that the cam is slid over to a position supporting a cam follower such that the axial force on the shell is removed at the bottom of the downstroke. During the upstroke, this condition is maintained. Later in the upstroke, actuator cams engage the cam to move the cam back to its original position, such that the cycle of the press can be repeated

BRIEF DESCRIPTION OF THE DRAWINGS

A presently preferred embodiment of the invention is described below in conjunction with the drawings, in which like reference numerals refer to like elements in the various views, and in which:

FIG. 4A shows a mid-form intermediate position in the down stroke.

FIG. 4B shows a cup form intermediate position later in the down stroke.

FIG. 4C shows a shut position corresponding to the bottom of the down stroke of the press.

FIG. 4D shows an intermediate stage of the upstroke of the press, showing the separation of the die center insert from the shell. Note the gap D1 existing between the top of the die center piston and the bottoming pad, indicating that the actuator pin is engaging the die center piston to move the die center piston to allow compressed gas to enter the region above the die center piston.

FIG. 4E shows a second, later intermediate stage of the upstroke of the press, again showing the separation of the die center insert from the shell. The gap above the die center piston is now D2, indicating that the actuator pin has further moved the die center piston relative to the bottoming pad. Note further that the shell is still clamped in the press; however in a subsequent stage of operation of the press the shell is stripped from the press allowing the cycle of FIG. 3 and FIGS. 4A-4E to be repeated.

FIG. 5A shows an open position of the tooling in the alternative embodiment.

FIG. 5B shows a midway hat form position during an initial part of the downstroke.

FIG. 5C shows a shut position corresponding to the bottom of the downstroke.

FIG. 5D shows an intermediate position in the upstroke.

FIG. 5E shows a finish pull down position later in the upstroke from the position shown in FIG. 5D.

DETAILED DESCRIPTION OF THE PREFERRED EMBODIMENTS OF THE INVENTION

Figure 1:
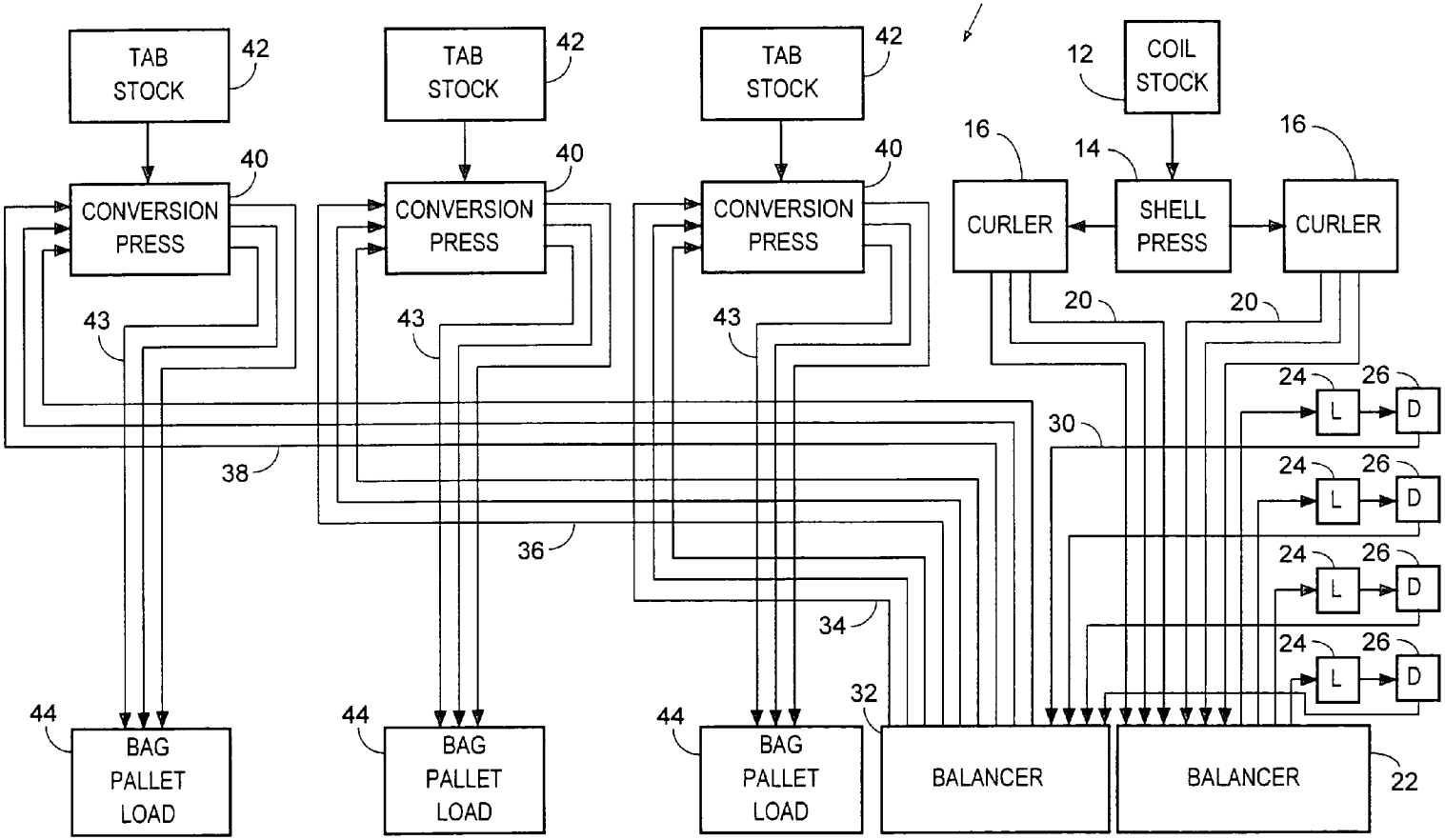
FIG. 1 PRIOR ART
FIG. 1 is a diagram of a can end manufacturing system. The system includes a shell press. The present inventive shell press and method can be used for the shell press in a system such as shown in FIG. 1.
Figure 1A:
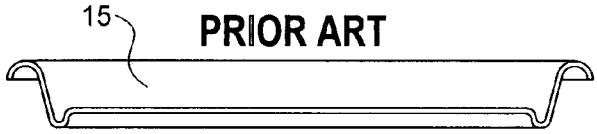
FIG. 1A PRIOR ART
FIG. 1A is a view of a shell made in the shell press of FIG. 1.
Figure 2A:
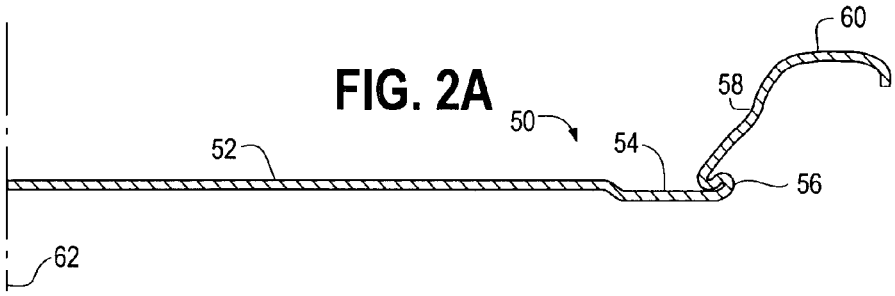
FIG. 2A is a cross-section of a representative shell made with the press of this invention.

The operation and construction of the press of this invention, and benefits and advantages following from its construction, its will be more easily appreciated with reference to a shell that may be produced in the press. FIG. 2A is a cross-section of a representative shell 50 made with the press of this invention. The shell 50 is not novel per se, and in fact the particulars of the shell design and form are not particularly important. The shell 50 is made from a blank, flat sheet of end material (e.g., aluminum alloy) that is fed in to the press. It will be understood that the sheet is typically sufficiently wide to enable multiple stations of the shell presses to operate on separate positions of the sheet transverse or oblique to the direction of movement of the sheet so as to maximize metal utilization; only one station press of the press will be described below with the understanding that other, multiple stations will typically be present.

Figure 2B:
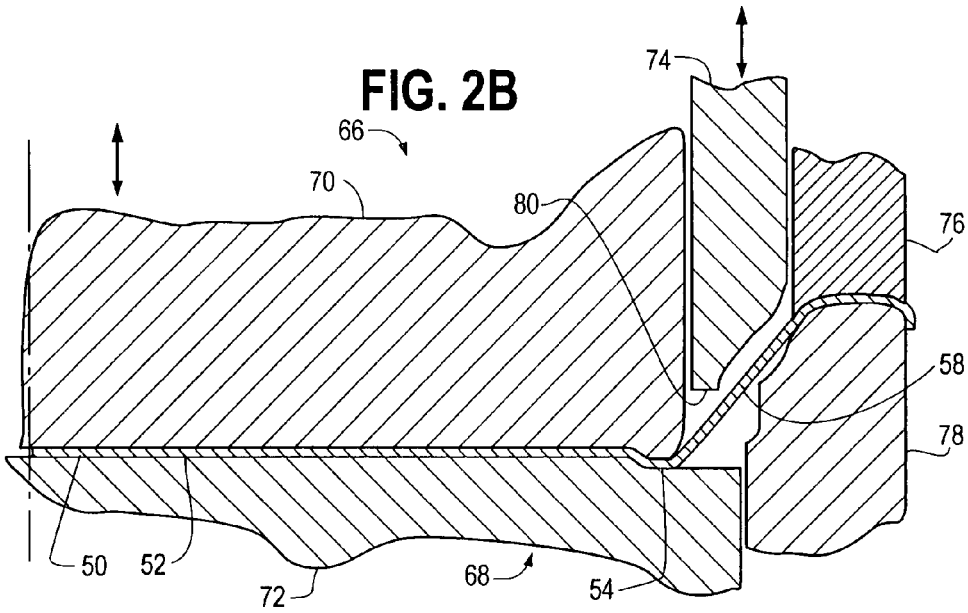
FIG. 2B is a cross-sectional view of a first forming operation in which a center panel is formed by a die center insert of the shell press of this invention, showing the position of portions of the upper and lower tools of the press during a down stroke of the press; note that the form punch insert has not yet come into contact with the shell, due to the differences in tooling height and construction of the upper tools.

The shell has a center panel 52, a peripheral panel 54, a fold 56, a side wall 58 and a peripheral curl 60. The shell is circularly symmetrical about a center axis 62. The forming of the shell of FIG. 2A is done in two steps. In a first forming operation, the sheet is drawn down to form a center panel 52. The curl 60 is also formed. This operation is shown in FIG. 2B. This first forming operation is sometimes referred to as forming a cup or "hat." FIG. 2B shows portions of an upper tool 66 and a lower tool 68. The upper tool 66 includes a die center insert 70, a form punch insert 74 and an upper or clamp piston 76. The lower tool 68 includes a panel punch insert 72 and a die core ring 78. When the tools close during the down stroke, the sheet of end material cut into a disc and the peripheral portion of the disc is clamped between the upper piston 76 and the die core ring 78. The die center insert 70 moves downwardly, engages the disk of end material to start to form the panel 52, and continues to draw the material down until the die center insert 70 and panel 52 seat against the panel punch insert 72. The press is constructed such that the downward movement of form punch insert 74 follows (lags behind) the downward movement of the die center insert 70, due to the stack and height of the tools as will be explained later. Note in FIG. 2B, the form punch insert 74, while moving downwardly, has not yet made contact with the shell in this first forming operation.

Figure 2C:
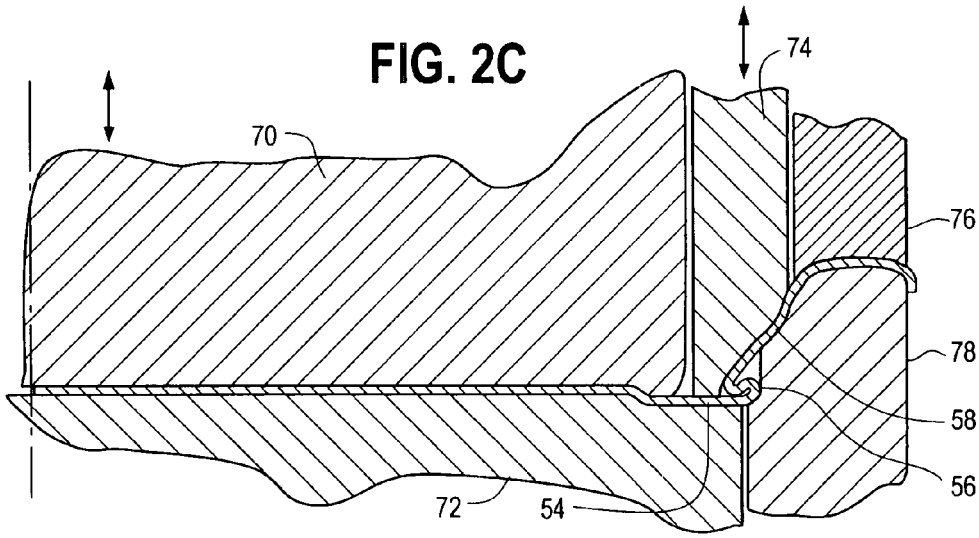
FIG. 2C is a cross-sectional view of a second forming operation in which a peripheral fold is formed in the center panel later in the down stroke of the press than shown in FIG. 2B, note that the form punch insert has engaged the shell side wall and peripheral panel to perform the second forming operation.

The second forming operation is shown in FIG. 2C. The press continues its down stroke until the tools are in the position shown in this Figure. The form punch insert 74 engages the side wall 58 and continues to move down relative to the die center insert 70 and upper piston 76 unit it, too, seats against the peripheral panel 54 and lower panel punch insert 72 as shown in FIG. 2C. This action causes the side wall 58 to buckle and form the fold 56. The contours of the peripheral edge of the form punch insert 74 and die core ring 78 are designed to give the side wall 58 of the shell the desired shape.

In a prior art single action press, at this stage, if the tools were to separate with the die center insert 70 remaining engaged against the shell 50 and panel punch insert 70 while the shell remained clamped in place by piston 76 and die core ring 78, the separation of the tools would cause a distortion of the fold 56 and the side wall 58, and result in an incorrectly formed shell. Hence, the art has developed double action presses to provide a mechanism for opening the upper and lower tools and allowing the die center insert 70 to disengage from the shell 50. A double action press is much more expensive to manufacture, operate and maintain than a single action press. The press and forming method of this invention allows for a single action press to perform the forming operation, with a mechanism or means for causing the die center insert 70 to disengage from the shell 50 at the beginning of the upstroke of the press to prevent any shell distortion from occurring during the upstroke. Moreover, in preferred embodiments the press includes an actuator feature for moving the die center insert 70 into a position such that it is ready for the next cycle of the press. The single action press of this invention allows for a single action construction, yet fast and reliable operation, and lower construction, operation and maintenance costs that is typically associated with double action presses.

Die Center Piston with Air Cavity Embodiment

Figure 3:
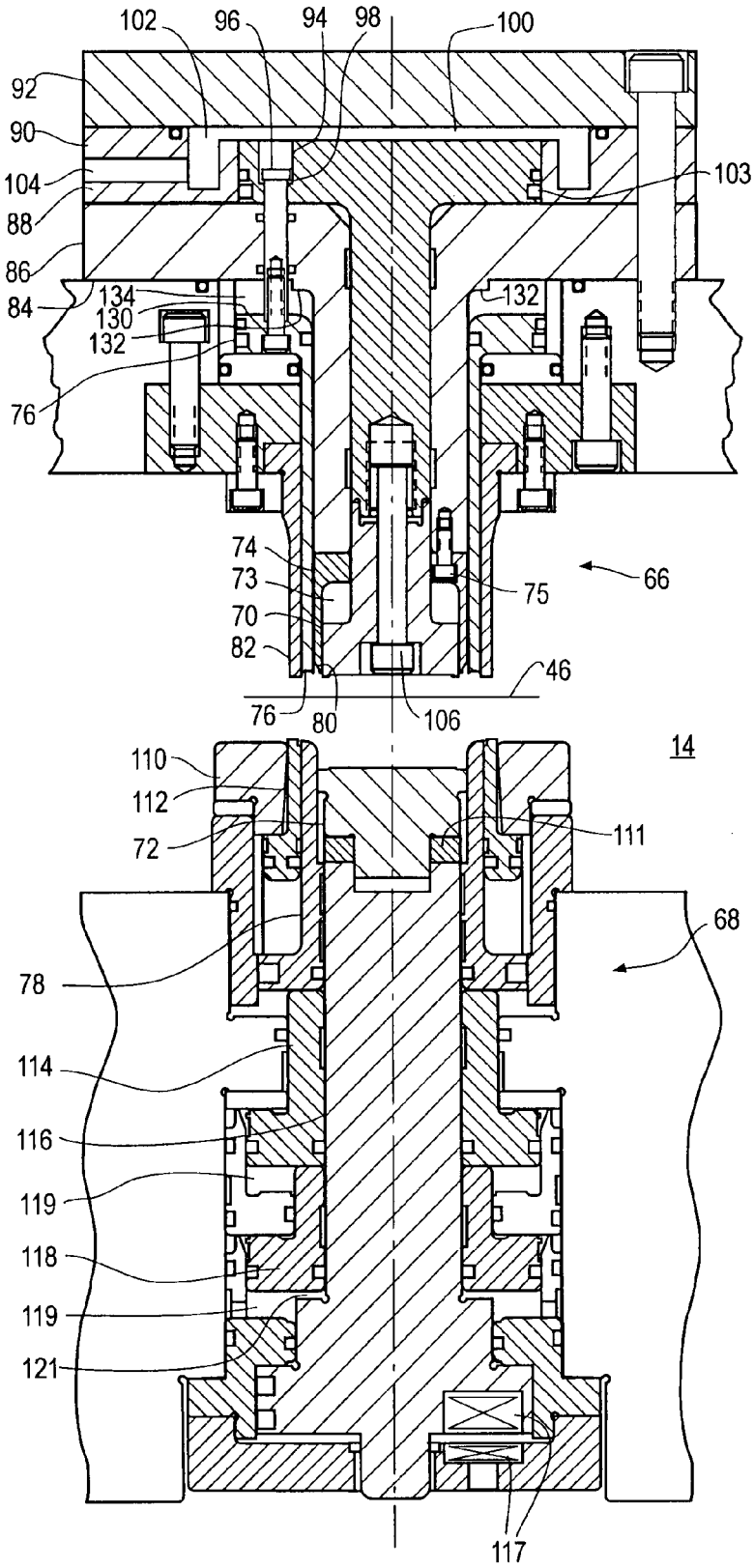
FIG. 3 is a cross-sectional view of the upper and lower tools of a preferred embodiment of the present inventive single action shell press, with the press in the open position during a cycle of operation of the press.

A preferred embodiment of the press 14 of this invention is shown in FIG. 3 in a cross-sectional view. The press 14 is shown in an open position in FIG. 3, with a sheet 46 of end material placed between the upper 66 and lower 68 tools, at the start of one cycle of the press. The upper tool 66 is shown in more detail in FIG. 4. A cycle of operation of the press of FIG. 3 is shown in FIGS. 4A-4E. In the following discussion, reference should be made to FIGS. 2A-2C, 3, and FIGS. 4, and 4A-4E.

Figure 4:
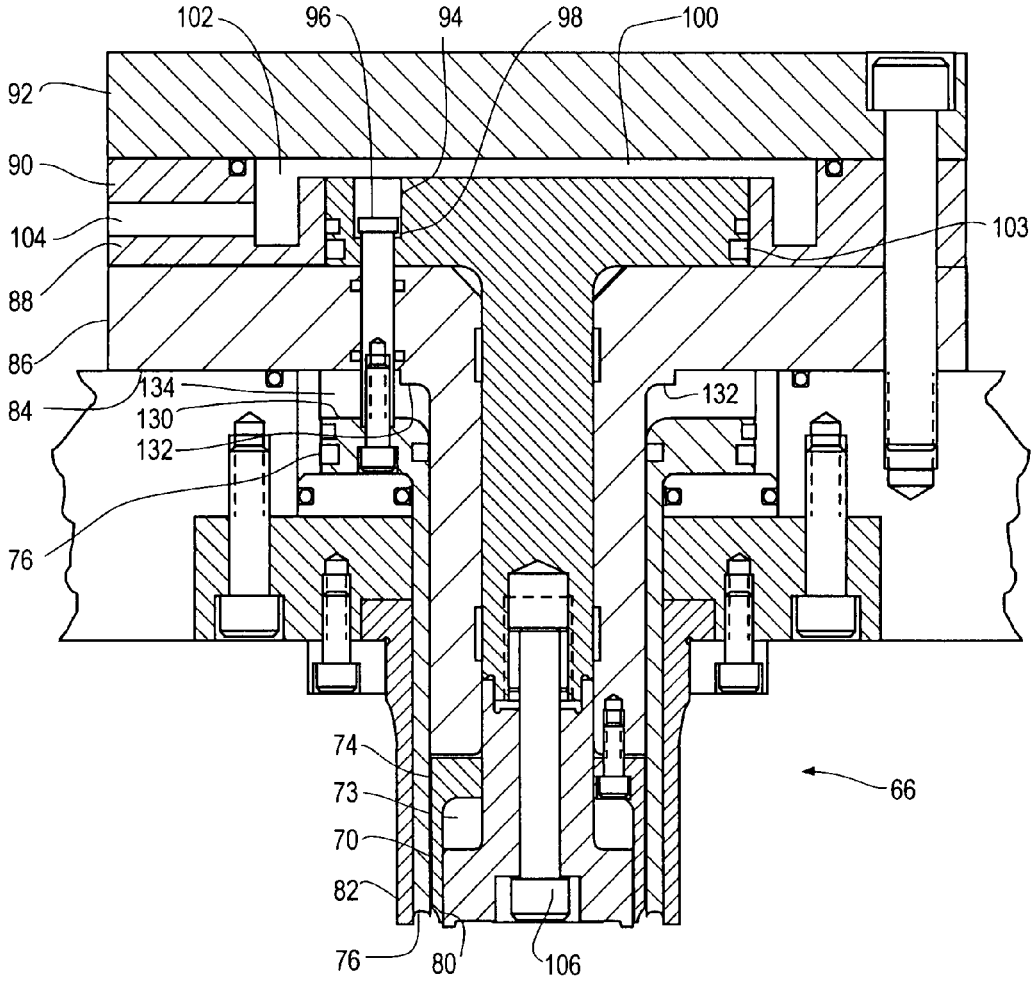
FIG. 4 is a more detailed cross-sectional view of the upper tools of the press of FIG. 3.

Referring primarily to FIGS. 3 and 4, a single action shell press 14 is shown in cross section, consisting of an upper tool or upper die assembly 66 and lower tool 68. The upper tool 66 is actuated by a single driving mechanism or ram, which is not shown in the drawings but is similar to those used in single and double action presses. The upper tool 66 sits in a die shoe, which is connected to the ram (the moving part), which is conventional. The press is considered "single action" in that a single driving mechanism, namely a ram driving the upper tool 66, is needed to operate the press and cycle the upper tool relative to the lower tool, whereas the prior art double action presses required two driving mechanisms for the upper tool, namely an inner ram driving the die center insert and an outer ram driving the outer tools, including the blank and draw die, form punch insert and a shell clamping structure.

The upper tool 66 includes a die center insert 70. The die center insert is rigidly attached to a die center piston 88 by means of a bolt 106. The operation of the die center piston 88 and die center insert 70 will be explained further below. A blank and draw die 82 is provided for blanking a circular disc from the sheet 46 of end material during the down stroke of the press. An upper piston 76 is provided which clamps the blanked disc against a die core ring 78 during the down stroke of the press and during the first part of the upstroke of the press. A form punch insert 74 is provided which performs the second forming operation on the shell as shown in FIG. 2C. The form punch insert 74 is attached to a form punch post 86 by means of bolts 75 spaced about the shoulder portion of the upper form punch insert 74 as shown in the right hand side of FIG. 3. A void 73 is provided between the upper shoulder of the die center insert 70 and the form punch insert 74 to provide space for the form punch insert 74 to move downward relative to the die center insert 70 at the bottom of the down stroke, as explained below.

As will be explained in more detail below, the die center piston 88 and attached die center insert 70 are moveable relative to the surrounding form punch post 86 and bottoming pad 92. FIG. 3 shows the tools in the open position with the die center piston 88 and die center insert 70 moved to a lower position. In this position, compressed gas (e.g., air) from a source (not shown) of compressed gas enters a bore 104 in an air chamber pad 90 located above the piston 76, enters into peripheral slots 102 arranged in the side of the air chamber pad 90, and fills a shallow cavity or void 100 immediately above the die center piston 88 and below a bottoming pad 92. This gas is compressed to high pressure, e.g., 400 pounds per square inch. As a result of compressed gas being present in the cavity 100, a downward, axial force is imparted onto the die center piston 88 and attached die center insert 70. This force causes the die center piston 88 and die center insert 70 to move such that the peripheral parts of the die center piston 86 are abutting the form punch post 86, as shown in FIG. 3.

During the downward stroke of the press, the die center piston 88 and die center insert 70 are in the lower position shown in FIG. 3. However, at the bottom of the down stroke, the die center piston 88 is moved to its upper position due to contact with the shell material 46 and the panel punch insert 42 wherein the upper portion of the die center piston 88 fully occupies the cavity or void 100, thereby displacing the compressed gas therein out of the void 100 and into the peripheral void spaces 102. Dynamic overthrow caused by the rapid change in direction of the upper tooling and its mass and the thermal expansion of the press and tooling results in what is known as an overstrike. The lower tool 68, and in particular the panel punch post 116 rests on high pressure springs 117 (FIG. 3) which absorb this energy, causing the combined upper piston 76, form punch post 86, die core ring 78, die core ring pistons 114 and 116 and panel punch post 118 to move down against the springs 117. This dynamic action, which occurs while the form punch insert 74 completes the forming operation of FIG. 2C, is sufficient to overcome the axial load on the top of the die center piston 88 and causes the die center piston 88 to move into the gap or void 100 and completely displace the compressed gas previously present therein.

When the die center piston 88 is in this upper position, there is no gas in the cavity 100 (the cavity ceasing to exist because it is fully occupied by the piston), and consequently there is no downward axial force acting on the piston 88. Gravitation forces, if any are insignificant due to friction between the seals 103 present in the periphery of the die center piston (see FIG. 3). Gravitational forces could also be counteracted by forming a spring pocket in the shoulder of the die center piston 88 and placing a spring in the pocket that bears against the form punch post 86. In any event, the presence of the compressed gas in the peripheral spaces 102 creates no downward axial force on the piston 88. Since there is no significant downward force acting on the die center piston 88 and attached die center insert 70, at the start of the upward stoke of the press the die center insert 70 disengages, that is, lifts off, of the shell. The shell 50 remains clamped between the die core ring 78 and the upper piston 76 due to the presence of compressed gas in the region 134 in FIG. 4.

An actuator pin 84 is provided for moving the die center piston 88 from the upper position in which it occupies the void 100, to a lower position as shown in FIG. 3. The actuator pin 84 includes a head 96 that is received in a bore 94 formed in the periphery of the die center piston 88. Later on in the upstroke, as described in further detail below, the head 96 of the actuator pin 84 engages the seat 98 in the bore and as the operates to pull the piston 96 away from seating engagement with the bottoming pad 92, allowing compressed gas to enter the space 100 above the top of the piston 88 from the surrounding voids 102 and causing the downward force from the compressed gas to act on the die center piston 88. This causes the die center piston 88 to move to the position of FIG. 3 and to be ready for the next cycle of the press.

The lower tools 68 of the press 14 of FIG. 3 are conventional. The lower tool 68 includes the die core ring 78, which has an upper surface which provides a clamping surface for clamping a shell as shown in FIGS. 2B and 2C. The lower tool also includes blank cutedge 110 for cutting the disc from the sheet of end material, a draw ring 112, a panel punch insert 72 providing a base for forming the bottom of the shell in conjunction with the die center insert 70 as shown in FIG. 2, and a pair of die core ring pistons 114 and 116 arranged around a central panel punch post 116. A set of springs 117 are provided around the base of the panel punch post 118. The assembly 78, 114 and 118 moves up and down due to the compression action of the upper and lower tools coming together. Compressed gas (e.g., air) is provided in spaces 119 to provide an upward axial force to force the lower die core ring pistons 114 and 118 to their position shown in FIG. 3 after the tools have separated. A spacer 111 is provided to correctly position the panel punch insert 72 and set the exact height of the cup form depth of the shell 50 as shown in FIG. 2C (i.e., the difference in height between the top of the die core ring 78 and the top edge of the panel punch insert 72).

Press Operation

Figure 4A:
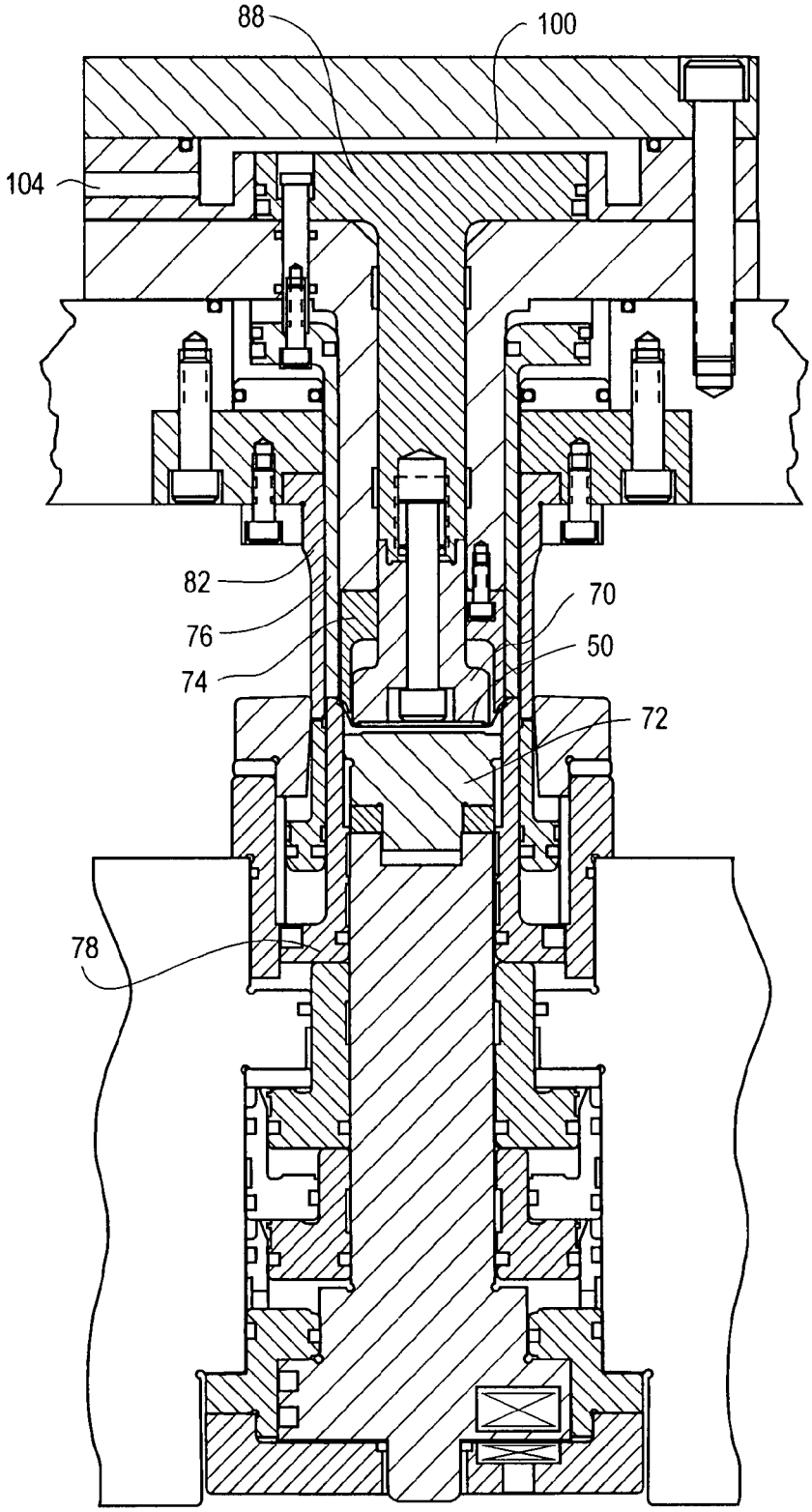
FIGS. 4A-4E show sequential positions of the press of FIG. 3 during a cycle of the press consisting of a down stroke and an upstroke.
Figure 4B:
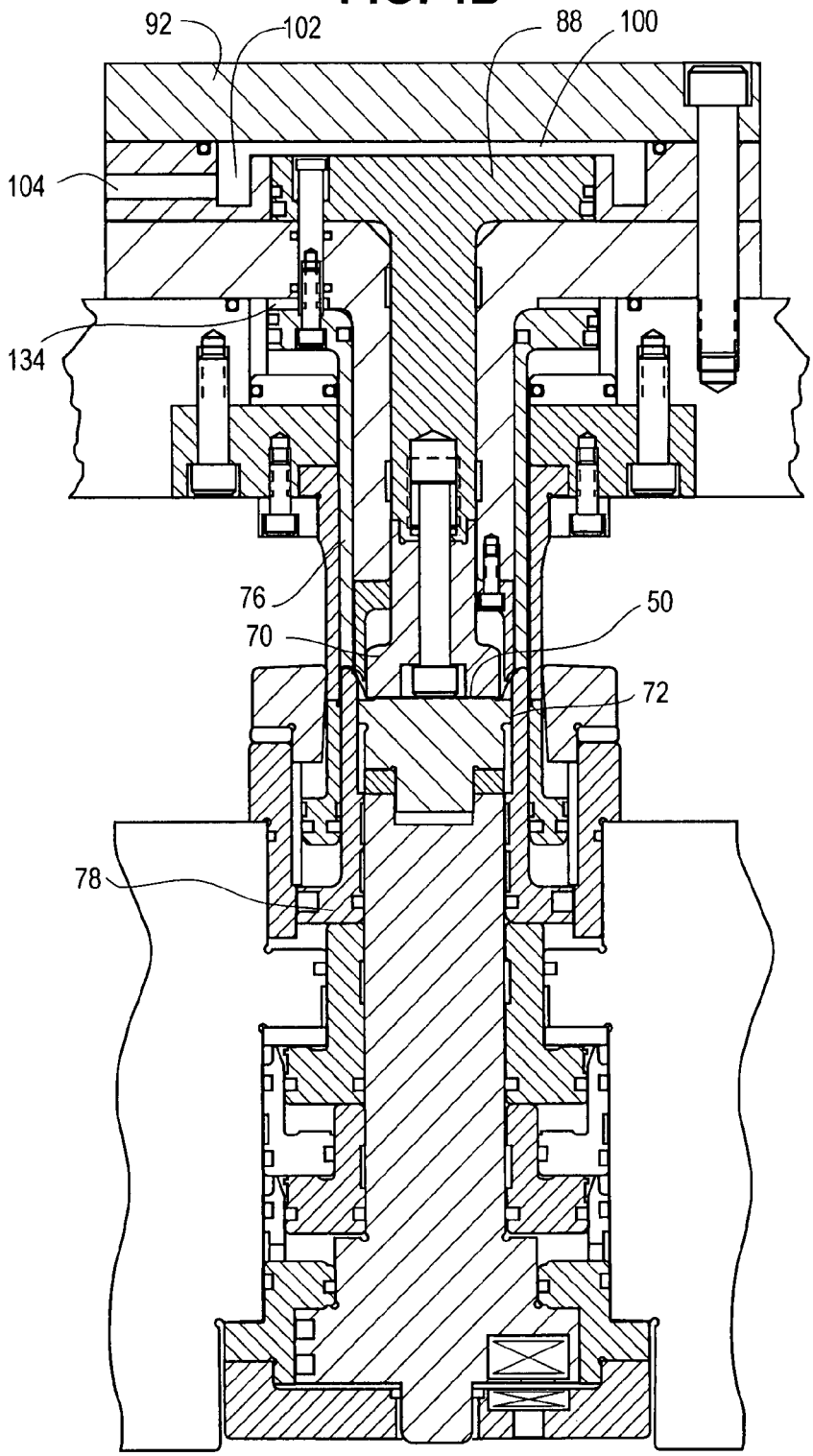
Figure 4C:
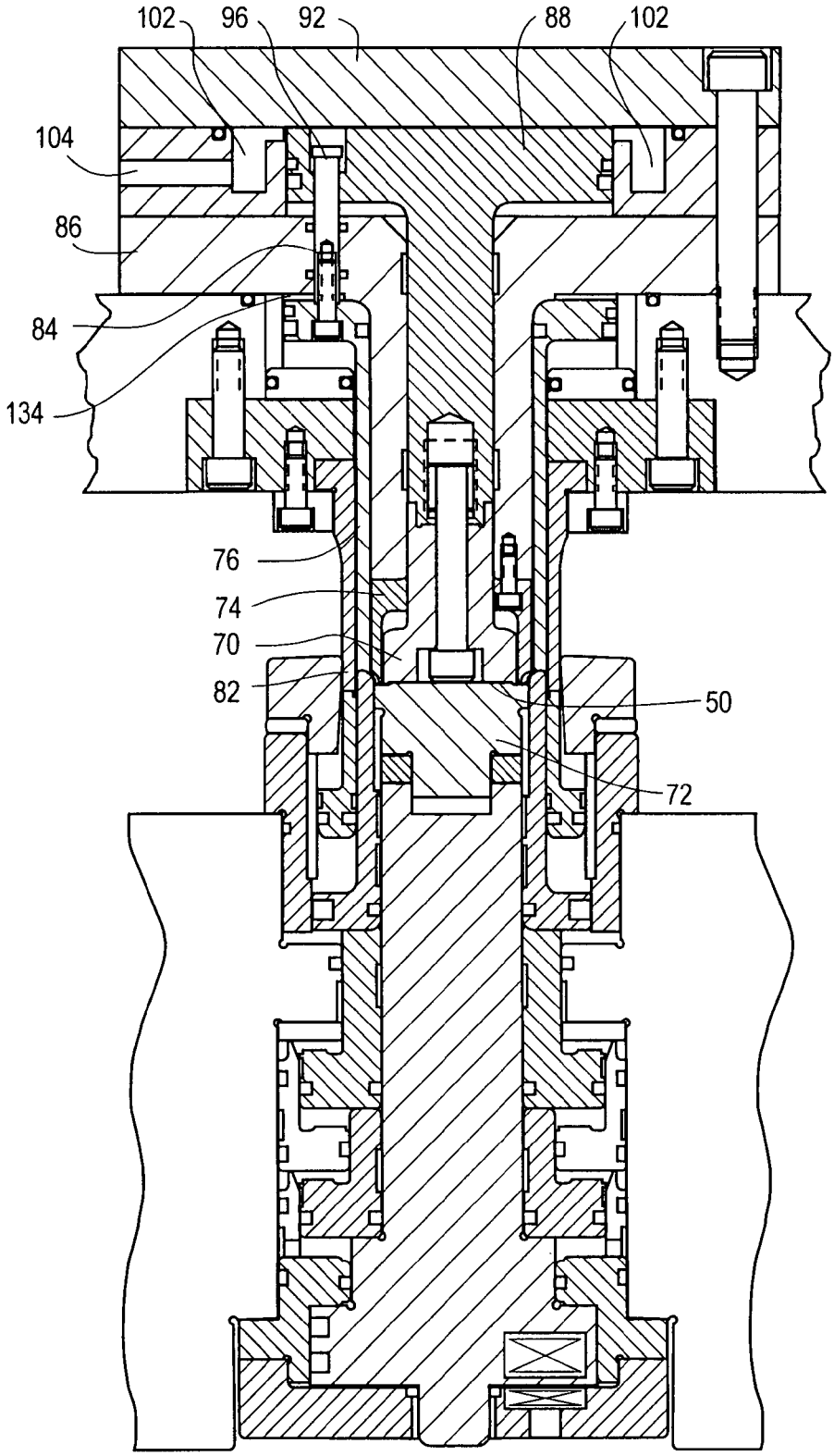
Figure 4D:
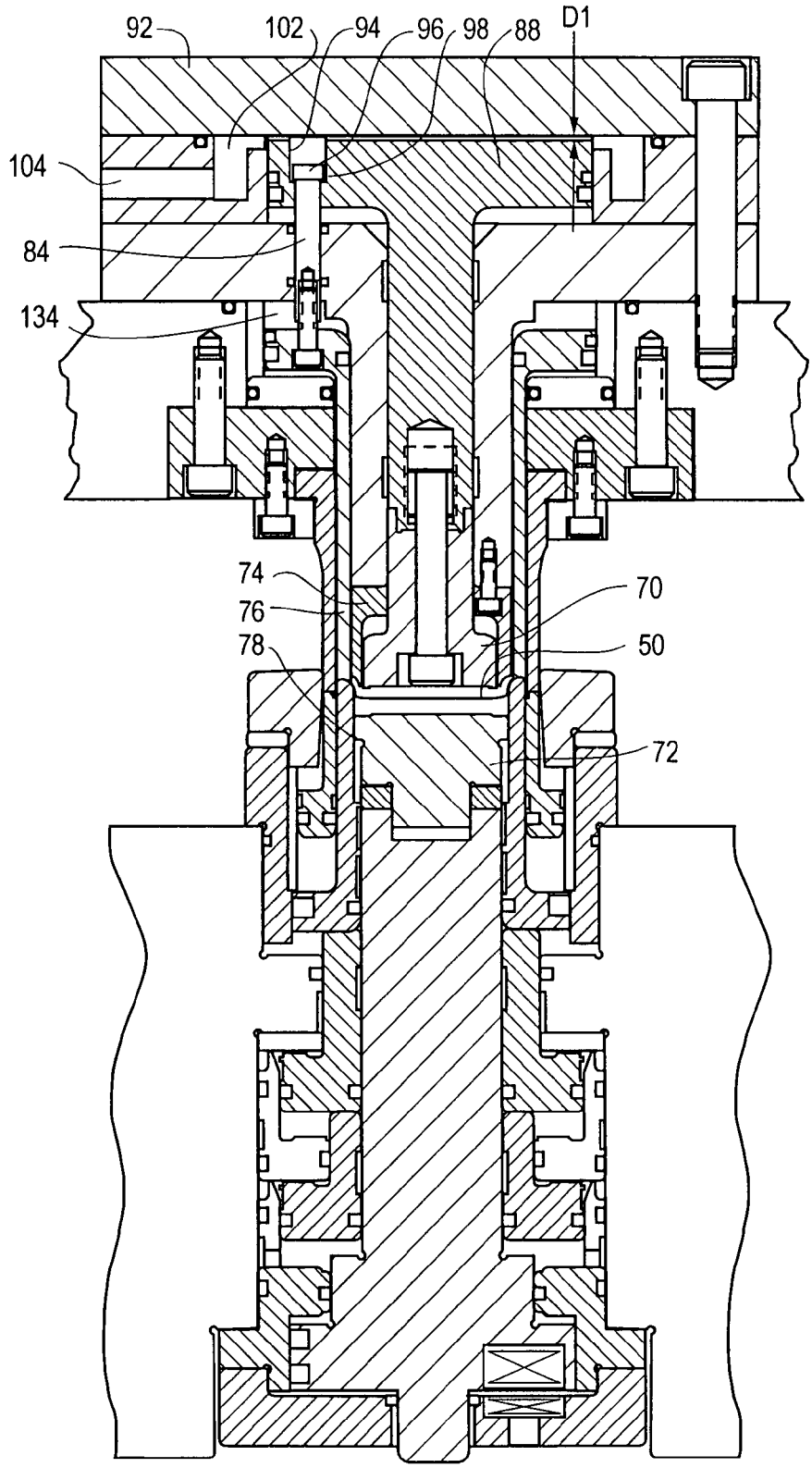
Figure 4E:
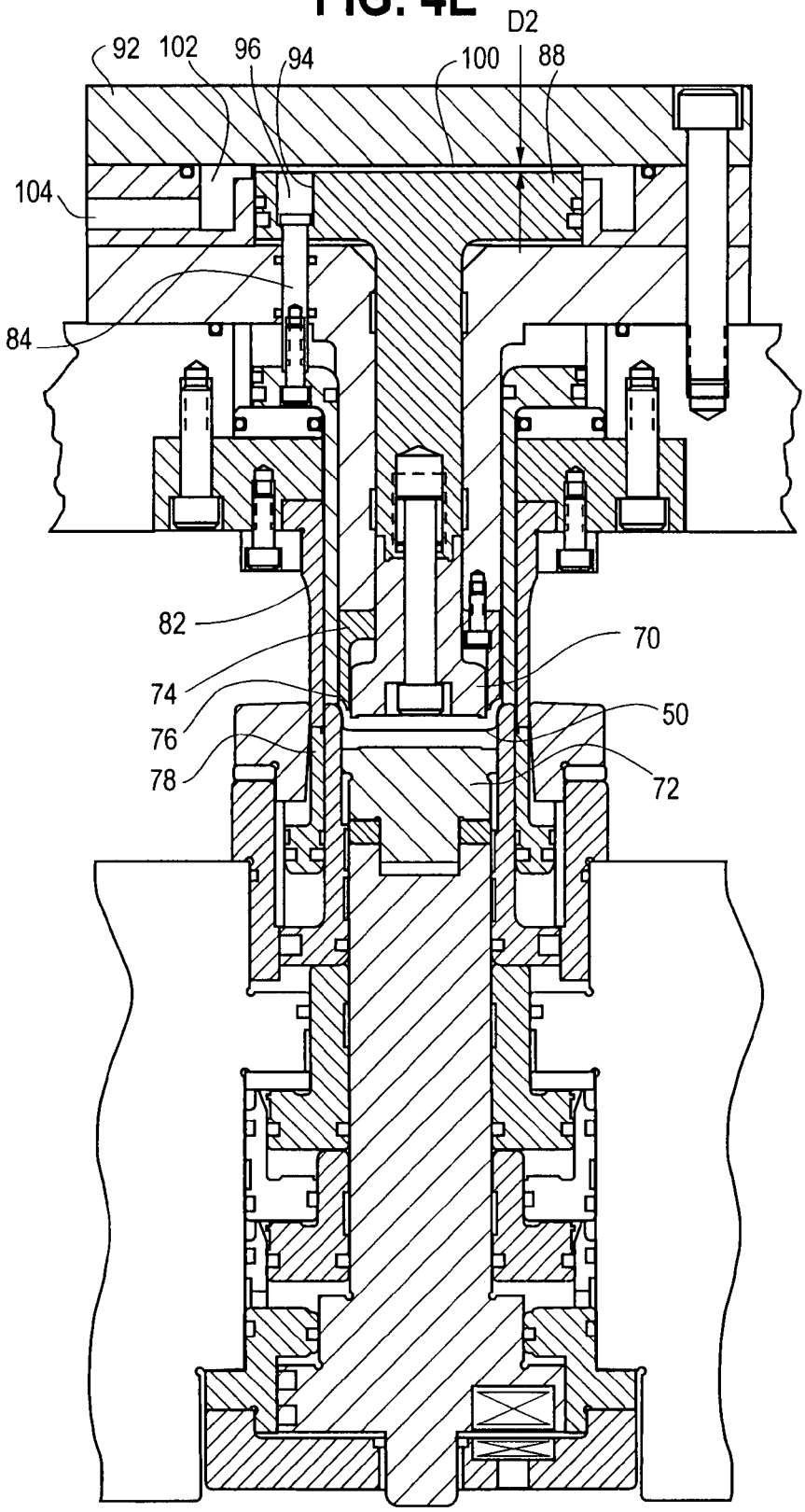

The operation of the press will now be further described in conjunction with FIGS. 3, 4, and 4A-4E. Before going into the details, an overview is provided first. FIG. 3 is a cross-sectional view of the upper and lower tools of a preferred embodiment of the present inventive single action shell press, with the press in the open position during a cycle of operation of the press. FIGS. 4A-4E show sequential positions of the press of FIG. 3 during a cycle of the press consisting of a down stroke and an upstroke. FIG. 4A shows a mid-form, intermediate position in the down stroke. FIG. 4B shows a cup form, intermediate position later in the down stroke. FIG. 4C shows a shut position corresponding to the bottom of the down stroke of the press. Note that the die center piston 88 is firmly seated against the air pad 92, displacing the compressed gas that was previously present above the piston 88. FIG. 4D shows a first intermediate stage of the upstroke of the press, showing the separation of the die center insert 70 from the shell 50. Note the gap D1 existing between the top of the die center piston 88 and the bottoming pad 92, indicating that the actuator pin 94 is engaging the die center piston 88 to move the die center piston 88 relative to the bottoming pad 92. FIG. 4E shows a second, later stage of the upstroke of the press, again showing the separation of the die center insert 70 from the shell 50. The gap above the die center piston is now D2, indicating that the actuator pin 84 has further moved the die center piston 88, relative to the bottoming pad. Note further that the shell is still clamped in the press; however in a subsequent stage of operation of the press (not shown) the shell is stripped from the press, allowing the cycle of FIG. 3 and FIGS. 4A-4E to be repeated.

This process will now be described in further detail. Referring to FIGS. 3, 4 and 4A, when the upper die assembly or tool 66 moves down during the beginning of the down stroke, the blank and draw die 82 engages the end material 46 and clamps it against the lower draw ring 112. The lower cutedge 110 and die 82 cuts a disc from the end material 46. Then, as the upper die assembly 66 continues to move down, the upper piston 76 holds and clamps the disc between the upper piston 76 and the lower die core ring 78 in the lower assembly. Then, as the down stroke continues, the lower most edge, and particularly the bottom corners thereof, of the die center insert 70 engage the disc and begins to draw the disc material into a cup. This drawing action occurs before the die center insert 70 seats on the panel punch insert 72, as shown in FIG. 4A. The die center insert 70 continues moving down until the die center insert 70 completes the first forming operation (panel or "hat" forming) as shown in FIG. 2B, at which time the die center insert seats against the panel punch insert 72.

During the down stroke, the die center piston 88 is moved away from the bottoming pad 92 such that compressed gas can enter the cavity 100 and thus impart a downward axial force (e.g., approximately 2000 pounds) on the die center piston 88. The actual force may vary depending on the surface area of the piston and the pressurization of the gas. This force insures that sufficient force exists on the die center insert such that it can draw the initial center panel in the shell and create the "hat" against the panel punch insert 72 as the upper tool moves towards the lower tool in the down stroke. The term "hat" is a reference to the general "hat" shaped cup form of the shell 50, as can be best seen by viewing FIG. 4A or 4B in an inverted condition.

At the same time as these operations are being performed during the down stroke, the form punch insert 74 and attached form punch post 86 are moving downwardly towards the lower tools. After the die center insert 70 has seated on the panel punch insert 72, an overstroke effect as described previously comes into play. The outer tools (upper piston and form punch insert 78 continue to move down. The delay or lag in the form punch contacting the shell 50 can vary by variation of the tool heights. Eventually, as shown in FIG. 2C, the lower edge 80 of the form punch insert 74 makes contact with the drawn cup or "hat" and clamps it against the shoulder of the die core ring 78. The form punch post 86 continues to move down until it bottoms out against upper piston 76. In particular, as best shown in FIG. 4, the ledge 132 in the form punch insert 74 moves down until it bottoms out against the upper shoulder 130 of the upper piston 76 and the two tools move downward together. Compressed gas (e.g., air) in the void region 134 is further compressed in the region 134 as shown in FIG. 4B. When this occurs, further downward motion of the upper die assembly 66 causes the lower die core ring 78, and die core ring pistons 114 and 118 to move down. The region 121 below the lower die core ring piston 118 is provided to absorb this downward movement in the lower tools.

Near the bottom of the down stroke, the die center insert 70 starts moving up relative to the form punch insert 74 and form punch post 86. That is, the die center insert 70 essentially remains fixed in position and the form punch insert 74 and form punch post 86 continue to move down during the remainder of the down stroke of the press. This overstroke action causes the die center piston 88 to occupy the void or cavity 100 and displace the compressed gas from this region. See FIG. 4C. The compressed gas is moved out of the cavity 100 and into the peripheral voids 102. The gas in the peripheral voids or slots 102 exerts no downward force on the piston 88 and die center insert 70.

At the same time, the upper piston 76 remains in contacts with the lower assembly die core ring 78. The continued downward movement of the upper tool causes the form punch insert 74 to move to its lowermost position and eventually seat against the panel punch insert 72 and complete the second forming operation, namely the creation of the fold 56 in the shell 50 and completion of the forming operation on the side wall 58 of the shell 50. At this point, the tools are in their shut or closed position at the bottom of the down stroke. See FIG. 4C and FIG. 2C.

At this point, the forming operations are complete and the press starts its upstroke. Since there is no axial force from compressed gas being exerted on the die center piston 88, when the upper die assembly 66 begins to move upwardly relative to the lower tools 68, the die center insert moves upwardly off of the shell 50 to insure that there is no deformation of the shell. Simultaneously, the form punch insert 74 also moves upwardly. The die core ring 78 now moves upwardly (due to force from compressed gas in regions 119) but the shell remains clamped between the die core ring 78 and the upper piston 76. The other components in the upper die assembly 66, including form punch insert 74 and die center insert 70, continue to move upwardly away from the lower tool 68.

At this point, and as shown in FIG. 4D, the actuator pin head 96 will bottom out on the shoulder seat 98 of the counter bore 94 (see also FIG. 4), and further upward movement of the upper die assembly 66 will cause the actuator pin 94 to pull the die center piston 88 away from the bottoming pad 92, allowing compressed gas to rush in and enter into the newly emerged space or cavity 100 above the die center piston 88 from the peripheral voids 102. The gap D1 is the space between the top of the piston 88 and the bottoming pad 92. Once the gas fills the cavity 100, a downward force is again exerted on the die center piston 88. However, at this time the tools 66 and 68 have separated enough such that when the die center piston and attached die center insert are moved to their lower position the die center insert 70 is well above the level of the shell 50 and does not interfere with the stripping of the shell 50 from the press 14. As the press continues its upstroke (FIG. 4E), the gap D2 between the top of the die center piston 88 and the bottoming pad has grown to its original value (same as in FIG. 3). Subsequently, the shell 50 is stripped from the press using compressed air.

It is believed that the press design of FIGS. 3 and 4 will allow the gas pressure to energize the piston 88 quickly enough for a press speed of 250 to 350 cycles per minute. Some routine experimentation maybe necessary on the timing of the stroke such that gas is exhausted from the top of the piston 88 at the bottom of the stroke and seals it off so that the piston completely fills the cavity 100 at the start of the upstroke.

As noted above, the actuator pin 94 design provides the mechanism by which the die center piston 88 is moved from its upper position (closing off the cavity 100) and its lower, energized position. The timing of the actuator pin 94 action as described above can be during the upstroke as described above or at the very end of the upstroke.

To the inventors' knowledge, prior art single action presses do not teach or suggest discharge of compressed gas above the die center piston 88 to thereby lift the die center insert off the shell during the upstroke, as disclosed herein. In prior art single action presses, the shell, and in particular the corner fold 56, would be deformed or destroyed on the upstroke because the shell would remain clamped between the die center insert and the panel punch insert as the die core ring 78 moved upwardly. In the present design, when the press is in the bottom of the down stroke, the gas is evacuated from the cavity 100 above the die center piston 88 and thus there is no longer any downward force on the die center piston 88 and die center insert 70. Thus, as the tools open during the upstroke, the upper piston 76 remains pressurized to clamp the shell against the die core ring 78, but the inner tools (form punch insert 74 and die center insert 70) can move upwardly out of engagement with the shell and eliminate any unwanted deformation of the shell.

In a further departure from the prior art, the actuator pin provides a mechanism of bringing the die center piston 88 to a condition where compressed gas can fill the void 100 above the die center piston and re-energize the piston for the following cycle of the press. Without any means to re-energize the piston with compressed gas, the exhausting of gas from the void 100 as shown in FIG. 4C would be futile since the press would not be ready for the next cycle of operation. In particular, the piston 88 would not have the force behind it to form the next shell. As noted above, the timing of the action of the actuator pin 84 engaging the die center piston 88 to pull the piston 88 down away from seating engagement with the bottoming pad 92 can occur during the upstroke or at the very end of the upstroke.

Cam and Cam Follower Embodiment

Referring now to FIGS. 5A-5E, a second embodiment of the inventive press is shown. Like the embodiment of FIGS. 3-4E, the press of FIGS. 5A-5E shares several common features: a) it is a single action press; b) it provides a means for applying and removing the axial force on the die center insert, and c) at the start of the upstroke, there is no axial force being applied by the die center insert to the shell to thereby prevent any unwanted distortion on the shell form. However, the press of FIGS. 5A-5E uses a different mechanism to provide the axial force on the die center insert (springs instead of gas pressure in the illustrated embodiment, but gas is a possibility) and a different mechanism to remove axial force from the die center insert at the bottom of the stroke.

Figure 5A:
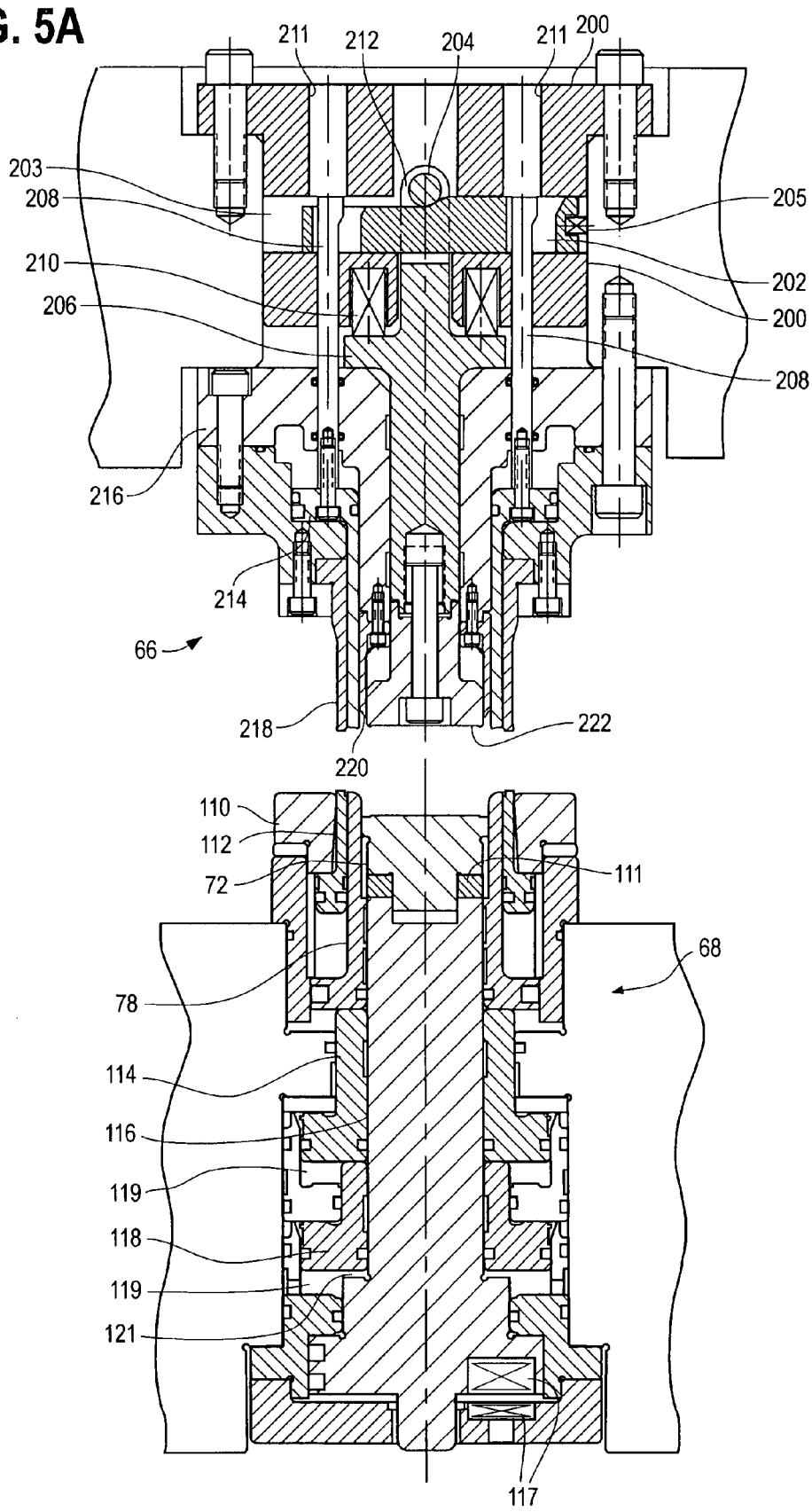
FIGS. 5A-5E illustrate a series of positions of an alternative embodiment of the press of FIG. 3, wherein a cam and cam follower are used to remove the axial force on the shell at the bottom of the downstroke.

Referring in particular now to FIG. 5A, this figure shows the upper and lower tools of the press in the open position. The upper tool includes a bottoming pad 200 having a transverse slot or groove 203 formed therein. A cam 202 reciprocates right to left in the slot 203. A die center cam follower 204 in the form of a roller is positioned above the cam 202. The cam follower is connected to a die center post 206 and sits in a channel 212 in the bottoming pad 200. A pair of die center springs 210 are received in pockets in the bottom of the bottoming pad 200 and urge against the peripheral shoulder portion of the die center post 206. A cam spring 205 is attached to the right hand edge of the cam 202 and serves to urge the cam 202 from right to left in the manner described in detail below.

Figure 5B:
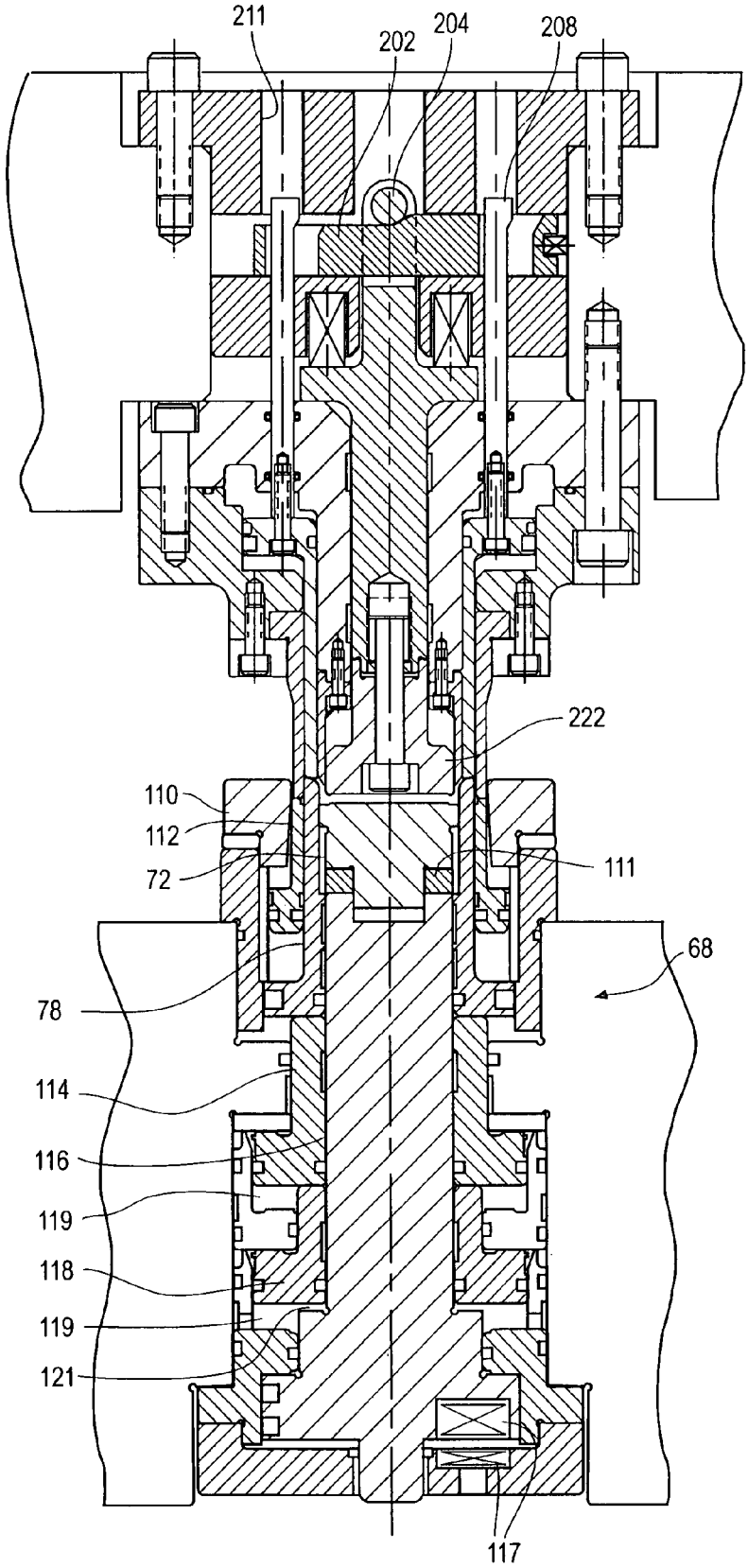
Figure 5C:
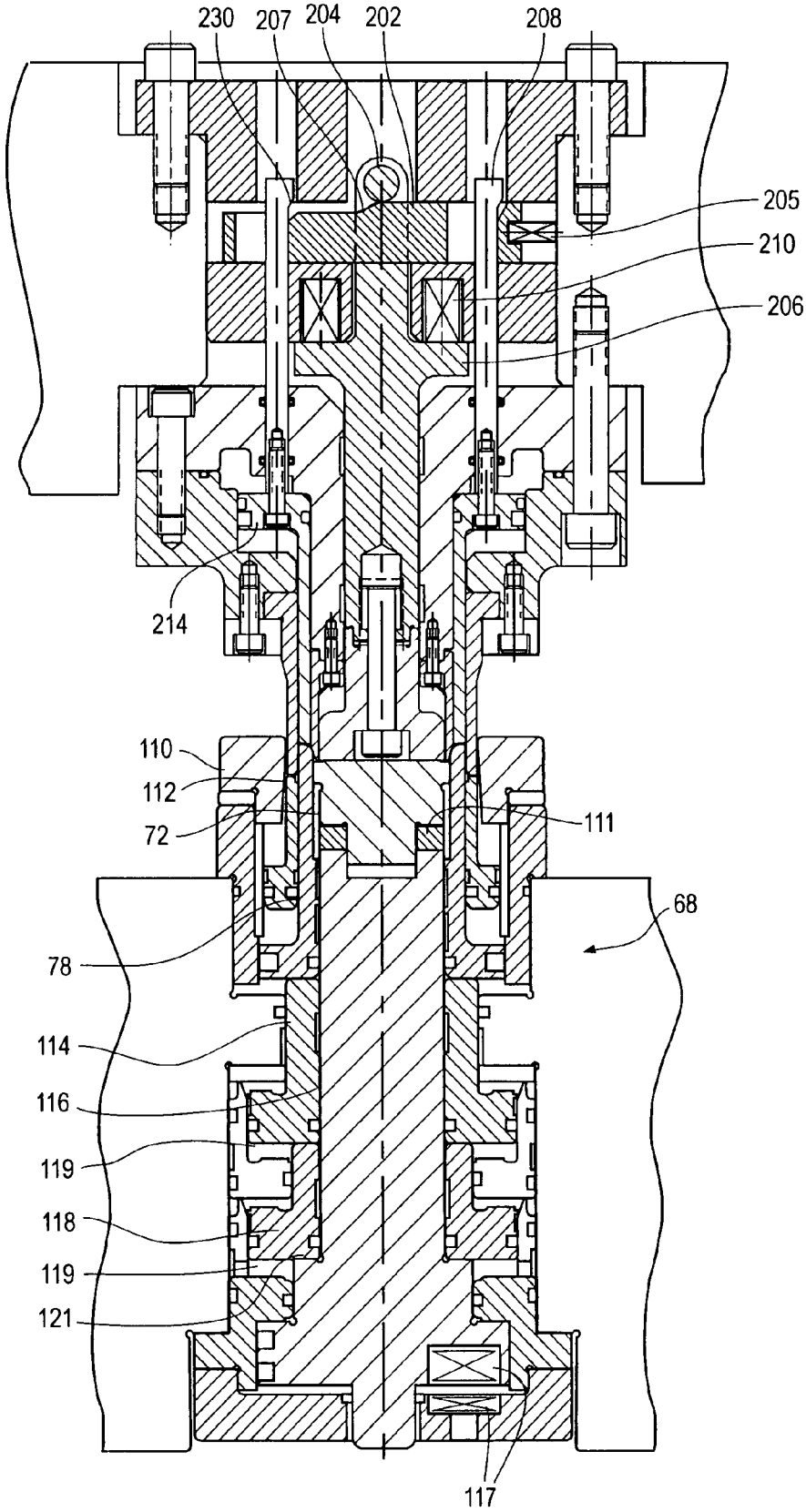
Figure 5D:
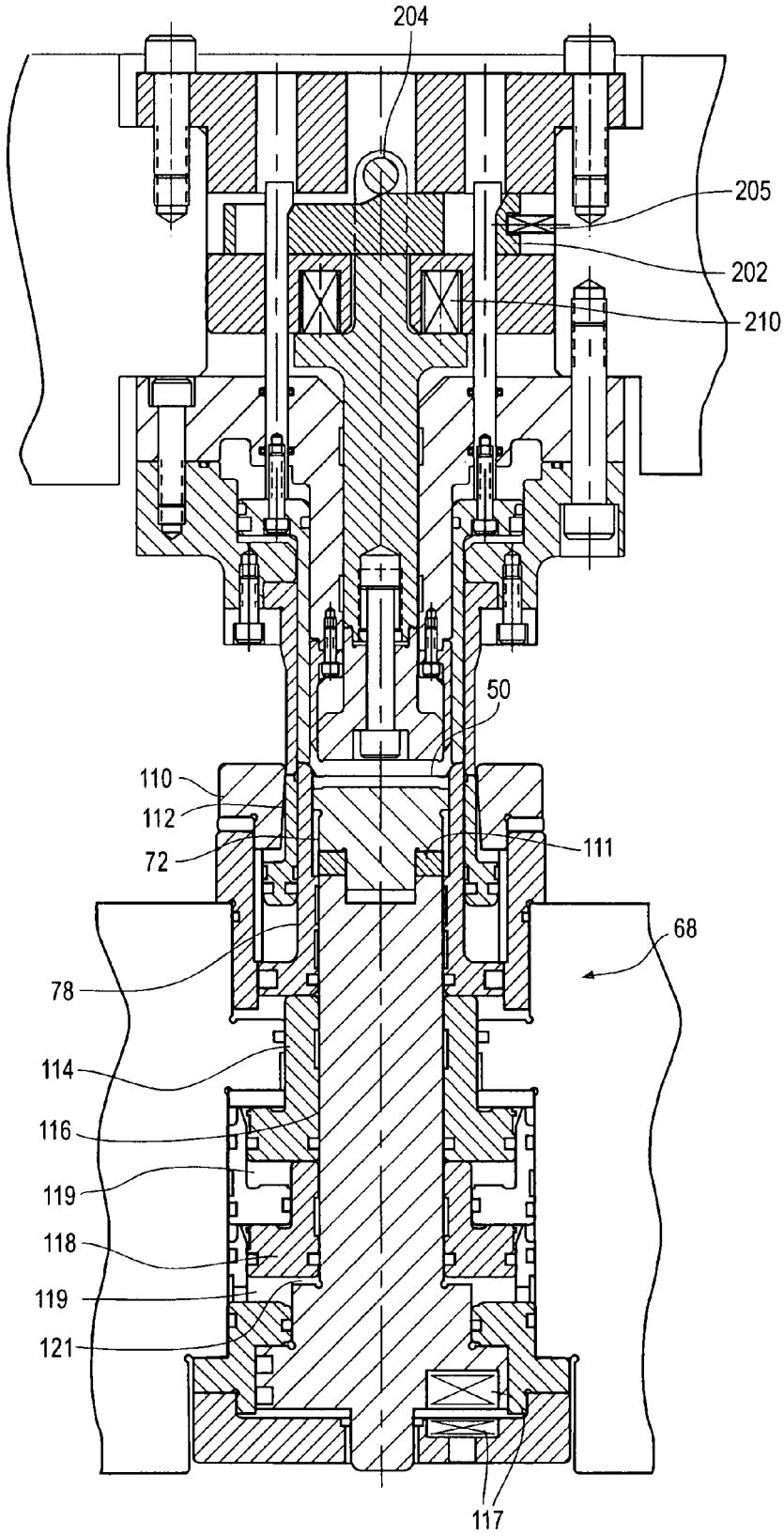

A pair of actuator cams 208 are provided which extend from the top portion of the clamp piston 214 through channels 211 formed in the lower portion of the bottoming pad 200, and extend through channels in the cam 202. The head of the actuator cams 208 are in registry with the channels 211 formed in the bottoming pad. The channels 211 allow the actuator cams to move up into the channel 211 as shown in FIGS. 5B-5D during a cycle of the press. The channels 211 could be a bearing surface to help guide the actuator cams 208 during the cam action described below. The cams 208 have a slanted cam surface 230 (FIG. 5C) which engages a complementary slanted surface on the cam 202 to move the cam to the right as described below.

The upper tool further includes a form punch post 216, a blank die 218, form punch insert 220 and a die center insert 222, similar to the embodiment of FIG. 3. The lower tool 68 is the same as the embodiment of FIG. 3, hence a detailed discussion is omitted. Like elements in the lower tool are given like reference numbers as provided in FIG. 3.

Press Operation

FIGS. 5A-5E illustrate a series of positions of an alternative embodiment of the press in one cycle of operation. FIG. 5A shows the tooling in the open position. The die center springs 210 supply an axial force to the die center post 206 and to the attached die center insert 222, and force the die center post to its lower position such that its peripheral shoulders seat on the form punch post 216 as shown. (A variation of this embodiment could use compressed gas to provide the axial force to the die center post, with the post 206 in this embodiment becoming a piston similar to the embodiment of FIG. 3.) The cam 202 is in its right hand position, with the die center cam spring 205 in a compressed condition as shown. A sheet of end material (not shown) is introduced into the space between the upper and lower tools for blanking and formation of a shell.

FIG. 5B shows a midway hat form position during an initial part of the downstroke. As the upper tool 66 moves down, the die center insert 222 performs the initial forming operation on the disk that is blanked from the web, similar to that of FIG. 4B. The springs 210 continue to exert downward axial force to the die center post 206 and die center insert sufficient to perform the initial hat forming operation on the blanked disk. The cam 202 remains in its right hand position. The clamp piston moves 214 moves upward relative to the surrounding tooling as can be seen from a comparison between FIGS. 5A and 5B. The head of the die center actuator cams 208 are moved into the channels 211 as shown as the clamp piston 214 moves upward relative to the surrounding tooling as shown.

FIG. 5C shows a shut position corresponding to the bottom of the downstroke. The clamp piston 214 has moved to its uppermost position such that it seats on the form punch post 216 as shown, moving the actuator cams further into the channels 211. An overstroke action (similar to that explained in the embodiment of FIGS. 3 and 4) lifts the die center post 206 and attached die center position to an upper position and overcome the force of the springs 210. This action causes the cam follower 204 to roll up the slanted cam surface 207 on the cam 202 as the spring 205 exerts a sideways force on the cam 202 and thereby allows the cam 202 to move from its right hand position to the extended, left hand position as shown in FIG. 5C. The upper surface of the cam 202 to the right of the slanted cam surface 207 supports the cam roller 204 (and integral die center post 206 and attached die center insert 222) in an upper position relative to the surrounding tooling in the upper tool. The upper tool is in the position shown in FIG. 5C when the tools separate in the start of the upstroke. At the start of the upstroke, there is no axial force imparted on the shell by the springs 210 due to the support of the cam follower 204 by the upper cam surface, and thus the die center insert 222 disengages from the shell at the start of the upstroke.

Figure 5E:
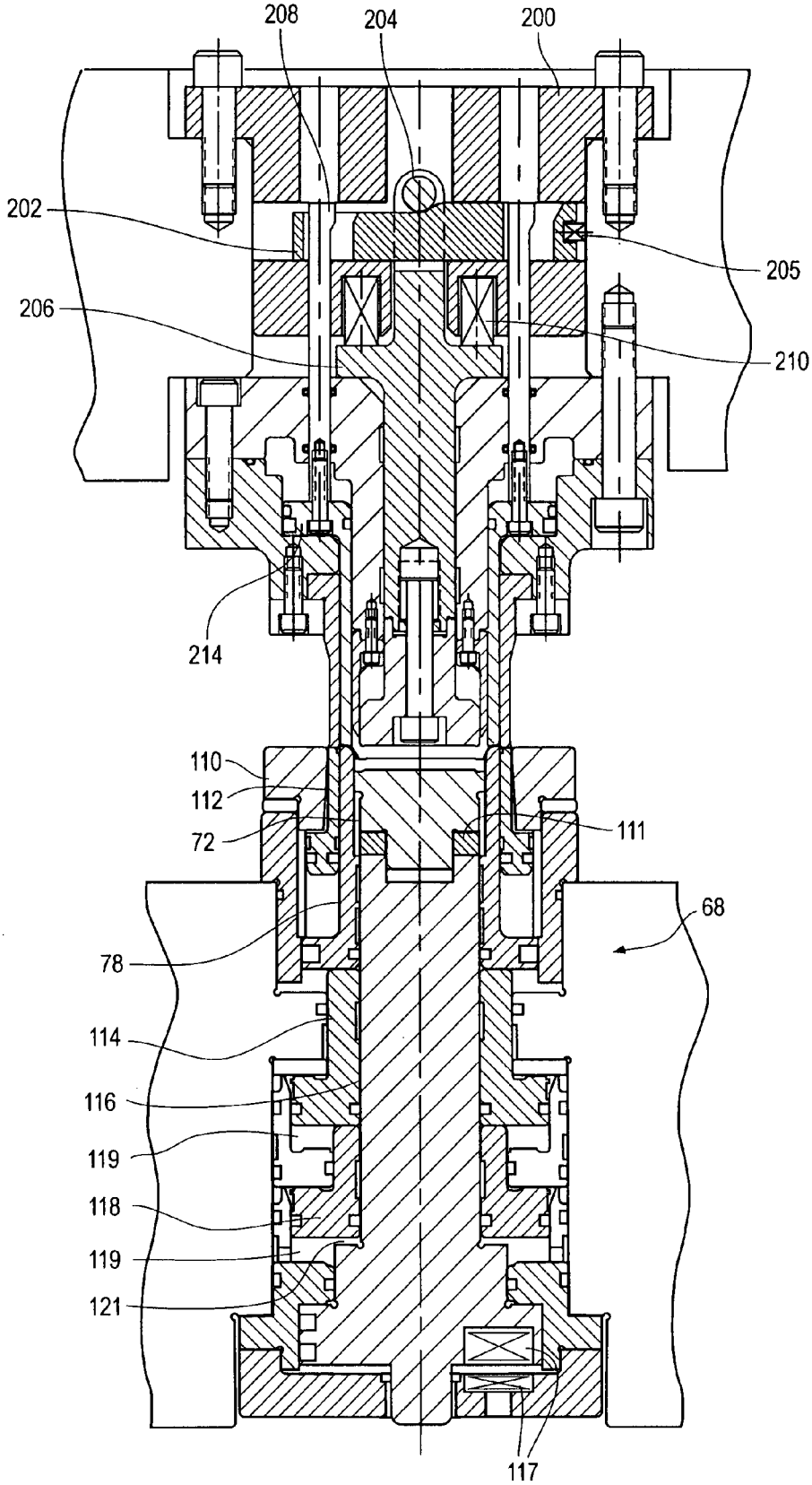

FIG. 5D shows an intermediate position in the upstroke. As the tools separate, the actuator cams 208 and attached clamp piston 214 move down relative to the cam 202. A camming action takes place between the slanted surfaces 230 of the head of the die center actuator cams 208 when these surfaces engages the corresponding adjacent slanted surfaces on the cam 202. As the tools further separate, the clamp piston 214 moves further down and the resulting cam action by actuator cams 208 causes the cam 202 to move to the right to its original position, compressing the die center cam spring 205. As soon as the cam follower 204 clears the upper edge of the slanted cam surface 207 as the cam 202 is moved to the right, the springs 210 are now free to fully extend and move the combined die center post 206 and attached die center insert 222 to their lower position. FIG. 5E shows a finish pull down stroke later in the upstroke from the position shown in FIG. 5D, showing the result of the camming action between the die center actuator cams 208 and the die center cam 202.

Thus, similar to the embodiment of FIG. 3, the die center actuator cams 208 provide a means for allowing the die center insert to be in a position for the next cycle of operation of the press. While in the embodiment of FIG. 3 the actuator pins engaged the die center piston and allowed air to re-enter the void region above the die center piston during the upstroke, the actuator cams 208 of FIG. 5A-5E perform an analogous operation: they engage with the cam 202 and move it to the right thereby allowing the springs 210 to supply downward force to the die center post and die center insert and ready the upper tool for the next cycle. While the actuator structures are somewhat different between the two embodiments, they serve a similar function.

As noted above, it is possible to use compressed gas in the place of springs 210 to cause downward forces to be imparted on the die center post 206 and die center insert 222. In this alternative embodiment, the die center post is essentially acting as piston. Compressed air is introduced from a source of compressed gas to the top surface of the die center post (e.g., where the springs 210 are presently configured). This compressed gas supplies an axial force to the die center post just as the case with the springs 210. The rest of the construction of the upper tool is the same. At the bottom of the stroke, the cam 202 supports the die center post. The cam and cam follower are moveable relative to the die center post into a position to support the die center post and remove axial forces imparted by the die center insert to the shell at the completion of the downstroke, in the same manner as shown in FIGS. 5C-5E.

Variation from the illustrated embodiments is contemplated within the scope of the invention. For example, the tools could be inverted and hence the terms "downwardly", "upwardly", and the like are intended to cover the opposite direction and are used only for the sake of illustration and not limitation. The design of the upper tools in general, including the die center piston and actuator pin features can be varied from the disclosed embodiments and yet retain the same functions as described herein, and such variations are considered equivalent to the disclosed constructions. As noted above, the particular features of the shell made in the press are not critical and the press design can be adapted to other configurations of shells.

We claim:

1. A method for manufacturing a shell for a can end in a single action press, said press having a down stroke followed by an upstroke, comprising the steps of:

1. in said down stroke,
   a) clamping a sheet of end material between first and second opposed tools in said press;
   b) performing a forming operation to form said shell from said sheet of end material with a die center insert in said first tool;
2. in said upstroke,
   a) initially retaining the clamping of said sheet of end material between said first and second tools,
   b) while said clamping in step 2.a) is performed, moving said center die insert into a condition of disengagement from said shell;

and c) releasing the clamping in step 2.a) and thereafter removing said shell from said press.

2. A method for manufacturing a shell for a can end in a single action press, said press having a down stoke followed by an upstroke, comprising the steps of:

1 in said down stroke, a) clamping a sheet of end material between first and second opposed tools in said press;

b) performing a forming operation to form said shell from said sheet of end material with a die center in said first tool;

2 in said upstroke, a) initially retaining the clamping of said sheet of end material between said first and second tools, b) while said clamping in step 2 a) is performed, moving said center die insert into a condition of disengagement from said shell;

and c) releasing the clamping in step 2 a) and thereafter removing said shell from said press;

wherein said first tool comprises a die center piston coupled to said die center insert and an actuator pin engaging said die center piston, and wherein said upstroke step 2. father comprises the step 2.d) of actuating said pin as to move said die center piston to thereby allow compressed gas to enter a cavity above said die center piston and exert an axial force on said die center piston.

3. The method of claim 2, wherein said actuator pin is mounted to an upper piston arranged in said first tool.

4. The method of claim 1, wherein said down stroke further comprises the step of:

c) moving a form punch insert arranged peripheral to said center die insert into engagement with said sheet of end material to perform a second forming operation to form said shell.

* * * * *